United States Patent [19]

Redding et al.

[11] Patent Number: 4,597,571

[45] Date of Patent: Jul. 1, 1986

[54] SHEET FEEDER STACK SUPPORT

[75] Inventors: Thomas P. Redding, Penfield; H. William Gray, Honeoye Falls, both of N.Y.

[73] Assignee: Xerox Corporation, Stamford, Conn.

[21] Appl. No.: 624,555

[22] Filed: Jun. 25, 1984

[51] Int. Cl.[4] ..... B65H 1/02

[52] U.S. Cl. ..... 271/150; 271/31.1; 414/330

[58] Field of Search ..... 271/30.1, 167, 10, 18, 271/35, 31.1, 37, 149, 150; 414/330

[56] References Cited

U.S. PATENT DOCUMENTS 3,313,537 4/1967 Garwood ..... 271/31.1
3,937,455 2/1976 Hauser ..... 271/10
3,947,018 3/1976 Stange ..... 271/99
4,348,019 9/1982 Stievenart et al. ..... 271/10

FOREIGN PATENT DOCUMENTS 1475178 6/1977 United Kingdom ..... 271/35

*Primary Examiner*—Bruce H. Stoner, Jr.
*Assistant Examiner*—Lawrence J. Goffney, Jr.
*Attorney, Agent, or Firm*—H. Fleischer; J. E. Beck; R. Zibelli

[57] ABSTRACT

An apparatus in which successive flexible sheets are advanced from a stack. One edge of the stack of sheets is supported rollably in a substantially vertical orientation. Successive outermost sheets are fed from one side of the stack. The stack of sheets moves toward a sheet feeder so as to position successive outermost sheets of one side thereof in a feeding relationship therewith.

10 Claims, 5 Drawing Figures

SHEET FEEDER STACK SUPPORT

This invention relates generally to an electrophotographic printing machine, and more particularly concerns an apparatus for advancing successive flexible sheets from a stack thereof.

In the process of electrophotographic printing, a photoconductive member is charged to a substantially uniform potential so as to sensitize the surface thereof. The charged portion of the photoconductive member is exposed to a light image of an original document being reproduced. Exposure of the charged photoconductive member selectively dissipates the charge thereon in the irradiated areas. This records an electrostatic latent image on the photoconductive member corresponding to the informational areas contained within the original document. After the electrostatic latent image is recorded on the photoconductive member, the latent image is developed by bringing a developer material into contact therewith. Generally, the developer material comprises toner particles adhering triboelectrically to carrier granules. The toner particles are attracted from the carrier granules to the latent image forming a toner powder image on the photoconductive member. The toner powder image is then transferred from the photoconductive member to a copy sheet. The toner particles are heated to permanently affix the powder image to the copy sheet.

In a commercial printing machine of the foregoing type, the copy sheets are generally stacked on a horizontal tray. An elevator system is employed to automatically move the tray in an upward, vertical direction so as to position successive uppermost sheets in contact with a sheet feeder. The sheet feeder then advances successive copy sheets in a horizontal direction to the respective processing stations within the printing machine. When the supply of copy sheets in the tray is below a pre-selected level, the printing machine is automatically de-energized, and the elevator moves the tray downwardly to an inoperative position for loading a new stack of copy sheets therein. A system of this type is fairly complex and limits the printing machines' configuration. It is desirable to simplify the copy sheet stacking and feeding system and to eliminate the elevator system associated therewith. This may be achieved by having the stack stand on an edge thereof. In this type of system, the copy sheet advances in a substantially vertical direction. This eliminates the requirement for an elevator, and for movement of the copy sheet support tray in a vertical direction. However, it is necessary to insure that the stack of sheets, supported on the edge thereof continually moves toward the sheet feeder. Only in this manner, will successive outermost sheets from the stack be advanced in the vertical direction. Various approaches have been devised for sheet feeding. The following disclosures appear to be relevant:

U.S. Pat. No. 3,937,455
Patentee: Hauser
Issued: Feb. 10, 1976
U.S. Pat. No. 3,947,018
Patentee: Stange
Issued: Mar. 30, 1976
U.S. Pat. No. 4,348,019
Patentee: Stievenart et al.
Issued: Sept. 7, 1982

The pertinent portions of the foregoing disclosures may be briefly summarized as follows:

Hauser describes a sheet feeder having a vertically oriented hopper storing a stack of sheets therein. Rollers are positioned at the bottom of the hopper to engage successive sheets and advance them downwardly to a scanner of a facsimile scanner.

Stange discloses a sheet feeder having a vacuum transport for advancing successive bottom sheets from a stack of sheets. An air cushion is formed between the bottom sheet and the plate adjacent thereto, and between the bottom edge of the sheet and the bottom edge guide. A follow-up plate engages the top sheet of the stack and applies a slight downward force on the stack.

Stievenart et al. describes a stack of vertically oriented sheets positioned in a magazine with the bottom end of the magazine being open. A pair of feed rollers advance successive sheets downwardly from the magazine through the open end thereof.

In accordance with one aspect of the features of the present invention, there is provided an apparatus for advancing successive flexible sheets from a stack thereof. Means, engaging one edge of the stack of sheets, rollably support the stack of sheets in a substantially vertical orientation. Means are provided for feeding successive outermost sheets from one side of the stack in the supporting means. Means, engaging the outermost sheet of the other side of the stack in the supporting means, move the stack on the supporting means toward the feeding means so as to position successive outermost sheets of one side of the stack in a feeding relationship therewith.

Pursuant to another aspect of the present invention, there is provided an electrophotographic printing machine of the type having a toner image formed on a photoconductive belt, wherein successive flexible sheets advance to a transfer station for receiving toner images thereat. Means, engaging one edge of the stack of sheets rollably support the stack of sheets in a substantially vertical orientation. Means are provided for feeding successive, outermost sheet from one side of the stack in the supporting means. Means, engaging the outermost sheet of the other side of the stack in the supporting means, move the stack toward the feeding means so as to position successive outermost sheets of one side of the stack in a feeding relationship therewith.

Other aspects of the invention will become apparent as the following description proceeds and in reference to the drawings, in which.

While the present invention will hereinafter be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appending claims.

Figure 1:
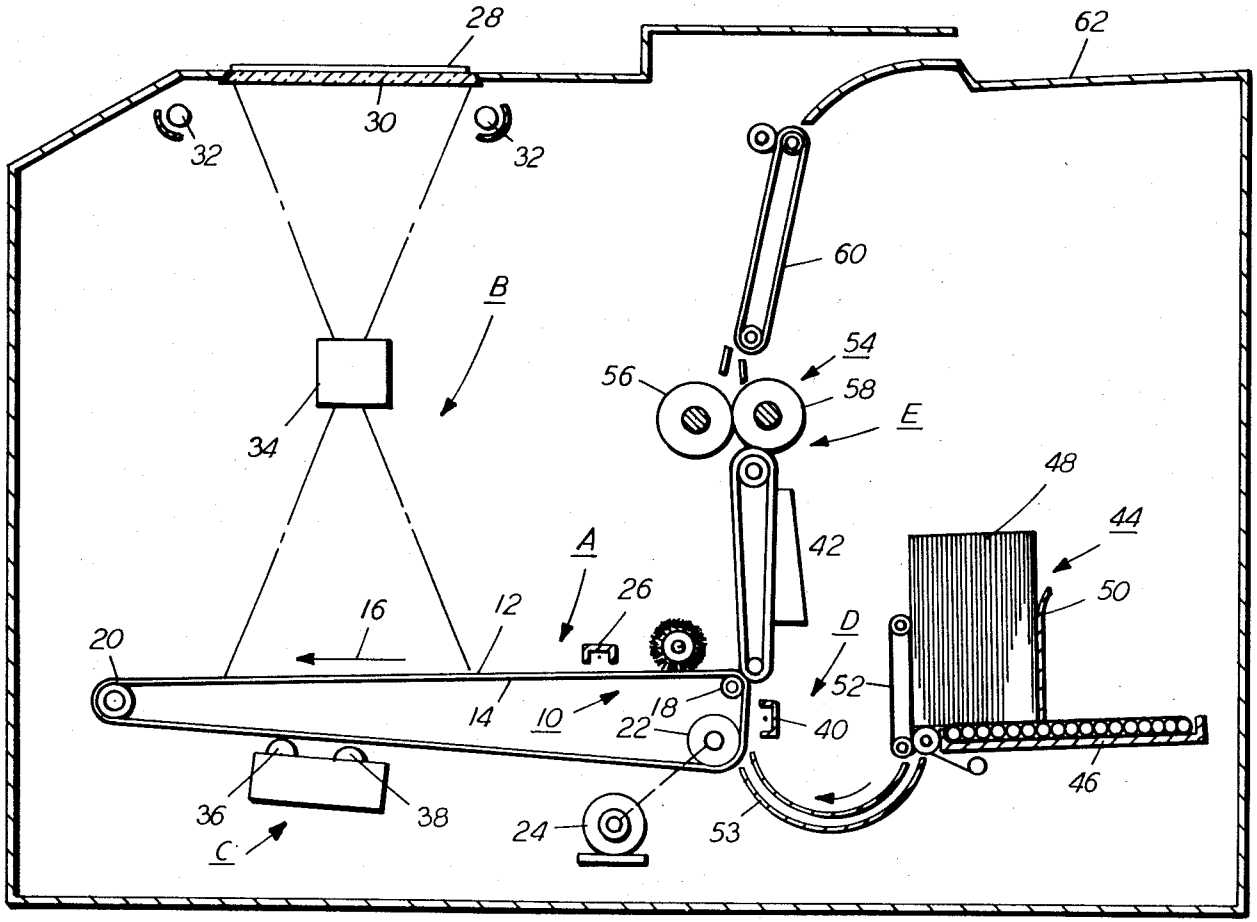
FIG. 1 is a schematic elevational view depicting an electrophotographic printing machine incorporating the features of the present invention therein.

For a general understanding of the features of the present invention, reference is made to the drawings. In the drawings, like reference numerals have been used to designate identical elements. FIG. 1 schematically depicts the various components of an illustrative electrophotographic printing machine incorporating the sheet feeding and stacking apparatus of the present invention therein. The sheet feeding and stacking apparatus of the present invention may be employed for stacking and advancing original documents, as well as copy sheets. It will become evident from the following discussion that this apparatus is equally well suited for use in a wide variety of printing machines, and is not necessarily limited in its application to the particular printing machine shown herein.

Inasmuch as the art of electrophotographic printing is well known, the various processing stations employed in the FIG. 1 printing machine will be shown hereinafter schematically and their operation described briefly with reference thereto.

As shownin FIG. 1, the electrophotographic printing machine employs a belt 10 having a photoconductive surface 12 deposited on a conductive substrate 14. Preferably, photoconductive surface 12 is made from a selenium alloy with conductive substrate 14 being made from an aluminum alloy. Other suitable photoconductive materials and conductive substrates may also be employed. Belt 10 moves in the direction of arrow 16 to advance successive portions of photoconductive surface 12 sequentially through the various processing stations disposed about the path of movement thereof. Belt 10 is entrained about a stripping roller 18, tensioning roller 20 and drive roller 22. Stripping roller 18 is mounted rotatably so as to rotate with the movement of belt 10. Tensioning roller 20 is resiliently urged against belt 10 to maintain belt 10 under the desired tension. Drive roller 22 is rotated by motor 24 coupled thereto by suitable means, such as a drive belt. As drive roller 22 rotates, it advances belt 10 in the direction of arrow 16.

Initially, a portion of the photoconductive surface passes through charging station A. At charging station A, a corona generating device, indicated generally by the reference numberal 26, charges photoconductive surface 12 to a relatively high, substantially uniform potential.

Next, the charged portion of photoconductive surface 12 is advanced through imaging station B. At imaging station B, an original document 28 is positioned face down on platen 30. Lamps 32 illuminate original document 28 disposed upon platen 30. Light rays reflected from the original document are transmitted through lens 34. Lens 34 focuses the light image of the original document onto the charged portion of the photoconductive surface of belt 10 to selectively dissipate the charge thereon. This records an electrostatic latent image on the photoconductive surface which corresponds to the informational areas contained within the original document. Thereafter, belt 10 advances the electrostatic latent image recorded on the photoconductive surface to development station C.

With continued reference to FIG. 1, at development station C a pair of magnetic brush rollers, indicated generally by the reference numerals 36 and 38, advance developer material into contact with the electrostatic latent image. The latent image attracts toner particles from the carrier granules of the developer material to form a toner powder image on the photoconductive surface of belt 10.

Belt 10 then advances the toner powder image to transfer station D. At transfer station D, a copy sheet is advanced into contact with the powder image. Transfer station D includes a corona generating device 40 which sprays ions onto the backside of the sheet. This attracts the toner powder image from photoconductive surface 12 of belt 10 to the sheet.

The sheet feeding and stacking apparatus, indicated generally by the reference numberal 44, advances successive copy sheets to transfer station D. Sheet feeding and stacking apparatus 44 includes a support member 46 supporting a stack of sheets 48 in a substantially vertical orientation. Guide Plate 50 engages one side of the stack of sheets 48 and presses thereagainst so that the stack of sheets moves on support member 46 toward feeder 52. In this way, successive outermost sheets from one side of stack 48 are continuously in a sheet feeding relationship with sheet feeder 52 so as to be advanced into chute 53. Chute 53 guides the advancing sheet to transfer station D. After transfer of the toner powder image to the copy sheet, the copy sheet is advanced by conveyor 42 to fusing station E. The detailed structure of sheet feeding and stacking apparatus 44 will be described hereinafter with reference to FIGS. 2 through 5, inclusive.

Fusing station E includes a fuser assembly, indicated generally by the reference numeral 54, which permanently affixes the transferred powder image to the copy sheet. Preferably, fuser assembly 54 includes a heated fuser roller 56 and a back-up roller 58. The sheet passes between fuser roller 56 and back-up roller 58 with the powder image contacting fuser roller 56. In this manner, the powder image is permanently affixed to the copy sheet.

After fusing the toner powder image to the copy sheet, the copy sheets are advanced by conveyor 60 to catch tray 62 for subsequent removal from the printing machine by the operator.

Invariably, after the copy sheet is separated from photoconductive surface 12 of belt 10, some residual particles remain adhering thereto. These residual particles are removed from photoconductive surface 12 at cleaning station F. Cleaning station F includes a rotatably mounted fiberous brush 64 in contact with photoconductive surface 12 of belt 10. The particles are cleaned from photoconductive surface 12 of belt 10 by the rotation of brush 64 in contact therewith. Subsequent to cleaning, a discharge lamp (not shown) floods photoconductive surface 12 with light to dissipate any residual electrostatic charge remaining thereon prior to the charging thereof for the next successive imaging cycle.

It is believed that the foregoing description is sufficient for purposes of the present application to illustrate the general operation of an electrophotographic printing machine incorporating the features of the present invention therein.

Referring now to the specific subject matter of the present invention, the general operation of the sheet feeding and stacking apparatus will be described hereinafter with reference to FIGS. 2 through 5 inclusive.

Figure 2:
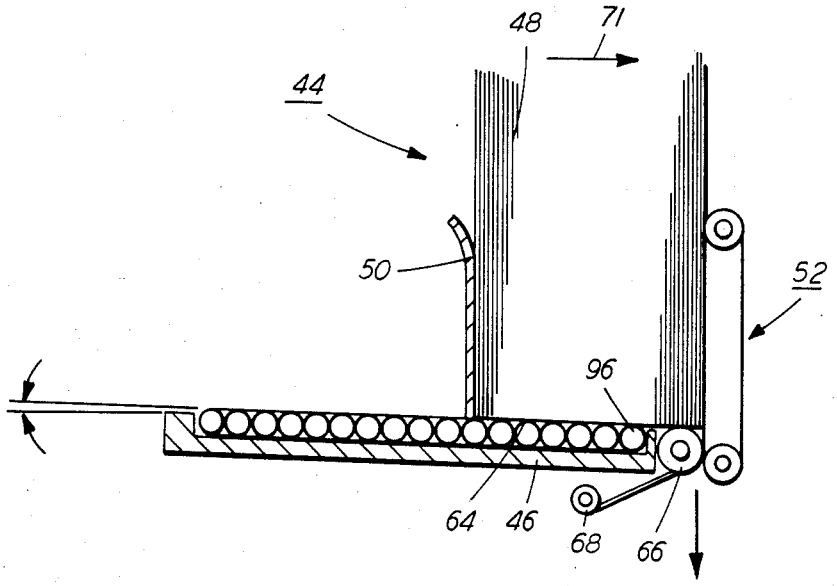
FIG. 2 is a schematic elevational view showing the sheet feeding and stacking apparatus of the FIG. 1 printing machine.

As shown in FIG. 2, sheet feeding and stacking apparatus 44 includes a support member 46 having stack 48 disposed thereon. The side edge of stack 48 engages member 46. A guide plate 50 contacts the outermost sheet of stack 48. Guide plate 50 is attached to flexible strips 64. Flexible strips 64 are wrapped around roller 66 onto pickup roll 68. Strip 64 may be a negator type of spring or, in lieu thereof, roll 68 may be driven by a spring motor. As roll 68 rotates, plate 50 presses against stack 48, causing stack 48 to move with strips 64 on balls 96 in tracks in support member 46, in the direction of arrow 71, toward sheet feeder 52. In this way, the outermost sheet of stack 48 opposed from guide plate 50 is positioned closely adjacent sheet feeder 52, i.e., in a sheet feeding relationship therewith. The detailed structure of sheet feeder 52 is shown in FIG. 3.

Figure 3:
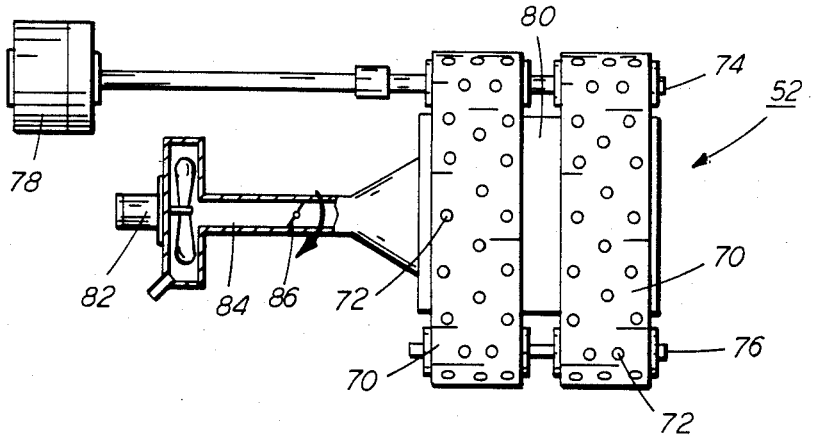
FIG. 3 is an elevational view showing the sheet feeder of the FIG. 2 sheet feeding and stacking apparatus.

Referring now to FIG. 3, sheet feeder 52 includes a pair of belts 70 having a multiplicity of substantially equally spaced apertures, or holes 72 therein. Belts 70 are entrained about spaced rollers 74 and 76. Roller 74 is coupled to a clutch drive 78 which rotates roller 74 so as to advance belt 70. Plenum 80 is disposed interiorly of belt 70. Blower 82 is coupled to plenum 80 via duct 84. A solenoid actuated valve 86 is positioned in duct 84. When valve 86 is opened, blower 82 exhausts air from plenum 80. In this way, a copy sheet on one side of stack 48 closely adjacent to belt 70 is attracted thereto. The copy sheet is then advanced by belt 72 to transfer station D (FIG. 1). When valve 86 is closed, air is not exhaused from plenum 80, and the copy sheets are not attracted to belt 70. The air exhausted by blower 82 is fed to an air knife (not shown) which directs a supply of air to the side edges of the stack. This facilitates the separation of the outermost sheet adjacent sheet feeder 52. In this way, the outermost copy sheet is attracted to belt 70 more readily and does not remain adhering to the remainder of the sheets of stack 48. The detailed structure of support member 46 is shown in FIGS. 4 and 5.

Figure 4:
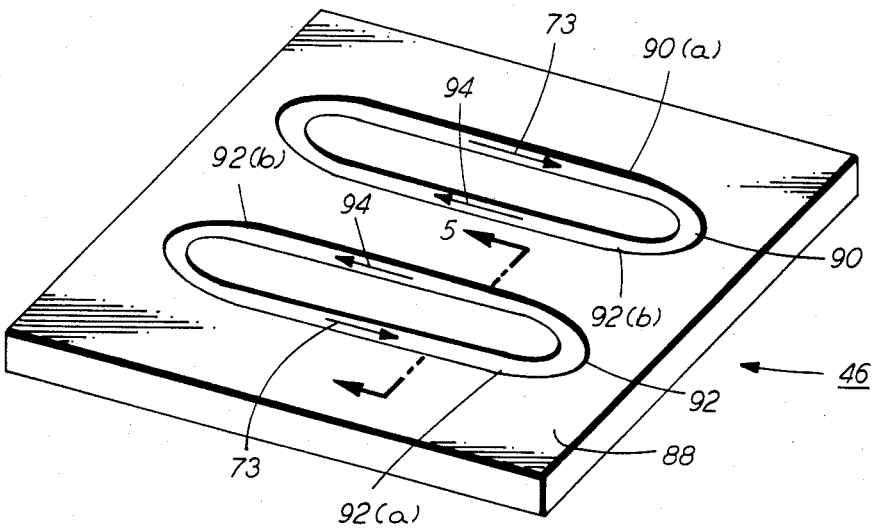
FIG. 4 is a schematic, perspective view depicting the stack support used in the FIG. 2 sheet feeding and stacking apparatus.

As shown in FIG. 4, support member 46 includes a generally planar member 88 having two endless, curvilinear grooves 90 and 92 therein. Groves 90 and 92 are race tracks. A plurality of balls 96 are positioned in grooves 90 and 92, the balls 96 provide a rolling support for stack 48. When stack 48 is moving toward the sheet feeder, balls 96 move in the direction of arrow 73 in portions 90(*a*) and 92(*a*) of grooves 90 and 92. the balls return to their initial position in portion 90(*a*) and 92(*a*) by travellingin the direction of arrow 94, through portions 90(*b*) and 92(*b*) of grooves 90 and 92, respectively. In this way, the balls in grooves 90 and 92 move in a continuously recirculating path.

Figure 5:
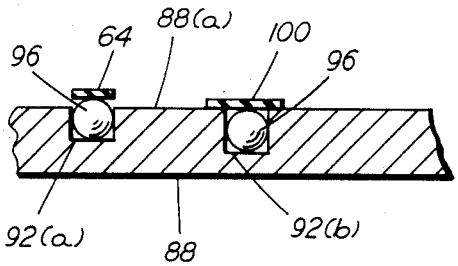
FIG. 5 is a fragmentary, sectional elevational view showing a portion of the FIG. 4 stack support.

Turning now to FIG. 5, there is shown a fragmentary, sectional elevational view depicting the detailed structure of groove 92. Groove 92 is identical to groove 90. As shown thereat, portion 92(*a*) of groove 92 is of a depth less than portion 92(*b*) thereof. Thus, as balls 96 move in portion 92(*a*) the exterior circumferential surface thereof extends above surface 88(*a*) of planar member 88. Strip 64 is positioned on balls 96. In this way, strip 64 supports the side edge of stack 48 as balls 96 move in portion 92(*a*) of groove 92. During the return path, i.e. after balls 96 move from portion 92(*a*) to portion 92(*b*), balls 96 have the exterior circumferential surface thereof below surface 88(*a*) of planar member 88. Cover 100 covers portion 92(*b*). Thus, when balls 96 are in the portion 92(*b*), they are merely returning to their initial position in portion 92(*a*). Inasmuch as there is a multiplicity of balls in portions 92(*a*) and 92(*b*) of groove 92, the balls are continually moving in a recirculating path. When balls 96 are in portion 92(*a*) they support strip 64 above surface 88(*a*) of planar member 88 and support the side edge of stack 48 rollably relative thereto. However, when balls 96 are in the return portion, i.e. portion 92(*b*) of groove 92, they are beneath surface 88(*a*) and no longer provide support for the side edge of stack 48. In this way, flexible strips 64 move with stack 48 with only rolling friction impeding motion.

In recapitulation, it is clear that the sheet feeding and stacking apparatus of the present invention supports a stack of sheets in a substantially vertical orientation. The sheets are supported rollably so as to move relatively freely toward the sheet feeder. A pair of grooves configured in the form of racetracks having different depths for the forward and return portions provide rolling support for the stack of sheets. This arrangement significantly reduces friction so as to facilitate movement of the stack toward the sheet feeder.

It is, therefore, evident that there has been provided, in accordance with the present invention, an apparatus for supporting vertically copy sheets used in an electrophotograhic printing machine. This apparatus fully satisfies the aims and advantages hereinbefore set forth. While this invention has been described in conjunction with a preferred embodiment thereof, it is evident that many alternatives, modifications, and variations would be apparent to those skilled in the art. Accordingly, it is attended to embrace all such alternatives, modifications, and variations as fall within the spirit and broad scope of the appended claims.

We claim:

1. An apparatus for advancing successive flexible sheets from a stack thereof, including:

a substantially planar member having a groove therein extending in an endless curvilinear path;

means, mounted rollably in the groove of said planar member, for engaging the side edge of the stack in one portion of the groove and being spaced from the side edge of the stack in the other portion of the groove;

means for feeding successive, outermost sheets from one side of the stack on said rollable means; and means, engaging the outermost sheet of the other side of the stack on said rollable means, for moving the stack toward said feeding means so as to position successive, outermost sheets of said one side of the stack in feeding relationship therewith.

2. An apparatus according to claim 1, wherein said engaging means includes:

a plurality of balls disposed in the groove of said planar member; and a strip supported by said plurality of balls arranged to be in rolling contact with the side edge of the stack of sheetsin said one portion of the groove in said planar member.

3. An apparatus according to claim 2, wherein said balls in said one portion of the groove have a portion of their exterior surface protruding above the surface of said planar member with the balls in said other portion of the groove having their exterior surface below the surface of said planar member.

4. An apparatus according to claim 3, wherein the depth of said one portion of the groove in said planar member is less than the depth of said other portion of the groove in said planar member.

5. An apparatus according to claim 4, wherein said plurality of balls disposed in the groove of said planar member roll in a recirculating path from said one portion of the groove to said other portion of the groove.

6. An electrophotographic printing machine of the type having a toner image formed on a photoconductive belt wherein successive flexible sheets advance to a transfer station for receiving a toner image thereat, wherein the improvement includes:

a substantially planar member having a groove therein extending in an endless curvilinear path;

means, mounted rollably in the groove of said planar member, for engaging the side edge of the stack in one portion of the groove and being spaced from the side edge of the stack in the other portion of the groove;

means for feeding successive, outermost sheets from one side of the stack on said rollable means; and means, engaging the outermost sheet of the other side of the stack on said rollable means, for moving the stack toward said feeding means so as to position successive, outermost sheets of said one side of the stack in feeding relationship therewith.

7. A printing machine according to claim 6, wherein said engaging means includes:

a plurality of balls disposed in the groove of said planar member; and a strip supported by said plurality of balls arranged to be in rolling contact with the side edge of the stack of sheets in said one portion of the groove in said planar member.

8. A printing machine according to claim 7, wherein said balls in said one portion of the groove have a portion of their exterior surface protruding above the surface of said planar member with the balls in said other portion of the groove having their exterior surface below the surface of said planar member.

9. A printing machine according to claim 8, wherein said balls in of said one portion of the groove in said planar member is less than the depth of said other portion of the groove in said planar member.

10. A printing machine according to claim 9, wherein said plurality of balls disposed in the groove of said planar member roll in a recirculating path from said one portion of the groove to said other portion of the groove.

* * * * *